US006729209B1

(12) United States Patent
Chen

(10) Patent No.: US 6,729,209 B1
(45) Date of Patent: May 4, 2004

(54) ROTATABLE TOOL DRIVING HEAD HAVING SPRING LOCK DEVICE

(76) Inventor: Chia Yu Chen, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/314,174

(22) Filed: Dec. 4, 2002

(51) Int. Cl.[7] ..... B25B 13/46
(52) U.S. Cl. ..... 81/63; 81/177.9
(58) Field of Search ..... 81/60–63.2, 58.1, 81/58.5, 177.1, 177.7, 177.8, 177.9

(56) References Cited

U.S. PATENT DOCUMENTS 3,186,265 A * 6/1965 Wenturine et al. ..... 81/177.9
4,711,145 A 12/1987 Inoue ..... 81/177.1
4,901,608 A 2/1990 Shieh ..... 81/177.8
6,000,302 A 12/1999 Chiang ..... 81/177.8
6,336,383 B1 * 1/2002 Hung ..... 81/60

* cited by examiner

*Primary Examiner*—Joseph J. Hail, III
*Assistant Examiner*—David B. Thomas

(57) ABSTRACT

A tool includes a driving head rotatably secured to a handle, an actuator member rotatably received in the driving head and having a depression and one or more recesses of different depths. Two detent members are biased to engage with the depression and the recess of the actuator member and to engage with the handle respectively. A rod is extended from one of the detent members and spaced away from the other detent member for different distances when the detent member is engaged with the depression and the recess of the actuator member.

6 Claims, 5 Drawing Sheets

ROTATABLE TOOL DRIVING HEAD HAVING SPRING LOCK DEVICE

BACKGROUND OF THE INVENTION

1. Field of the Invention

The present invention relates to a tool, and more particularly to a tool having a rotatable or adjustable driving head.

2. Description of the Prior Art

Various kinds of typical tools comprise a rotatable or adjustable driving head attached to a handle and rotatable relative to the handle, and a pawl device engaged between the handle and the driving head for adjustably locking the driving head to the handle at different or selected angular positions.

U.S. Pat. No. 4,711,145 to Inoue, and U.S. Pat. No. 6,000,302 to Chiang, disclose two of the typical tools each having a pawl movable and forcible to engage with and to lock the driving head to the handle with an actuator member. However, the actuator member should be rotated or moved relative to the handle or the driving head, before the driving head may be loosed or locked to the handle.

U.S. Pat. No. 4,901,608 to Shieh discloses another typical tool also including a driving head rotatably secured to a handle with a shaft, and a gear is engaged onto the shaft and engaged with the driving head. A button is slidably engaged in the handle and selectively engaged with the gear to lock the driving head to the handle. However, the driving head may not be rotated relative to the handle unless the button is depressed into or relative to the handle.

The present invention has arisen to mitigate and/or obviate the afore-described disadvantages of the conventional tools.

SUMMARY OF THE INVENTION

The primary objective of the present invention is to provide a tool including a spring biasing device continuously engaged between the driving head and the handle for preventing the driving head from freely rotating relative to the handle.

The other objective of the present invention is to provide a tool including a spring biasing device engaged between the driving head and the handle for allowing the driving head to be easily rotated relative to the handle without depressing any button.

In accordance with one aspect of the invention, there is provided a tool comprising a handle including a first end having a plurality of cavities formed therein and defined between bulges, a driving head including a first end rotatably secured to the first end of the handle, and including a second end, and including a middle portion having a groove formed therein, an actuator member rotatably received in the driving head, and rotatable relative to the driving head to a non-working position and at least one working position, and the actuator member including a depression and at least one recess formed therein, a first detent member selectively engageable with the depression and the recess of the actuator member, a second detent member selectively engageable with either of the cavities of the handle, and a spring engaged between the first and the detent members to bias the first and the second detent members to engage with the actuator member and the handle.

The depression of the actuator member includes a depth greater than that of the recess of the actuator member.

The first detent member includes a rod extended therefrom and located between the first and the second detent members. The bulges of the handle includes a height, a distance between the rod and the second detent member is shorter than the height of the bulges when the actuator member is rotated relative to the driving head at the non-working position, and is greater than the height of the bulges when the actuator member is rotated relative to the driving head at the working position.

The driving head includes a driving member rotatably received in the first end thereof, the actuator member has at least one tooth engaged with the driving member when the actuator member is rotated relative to the driving head at the working position.

An activating member may further be provided and attached to the actuator member for rotating the actuator member relative to the driving head.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
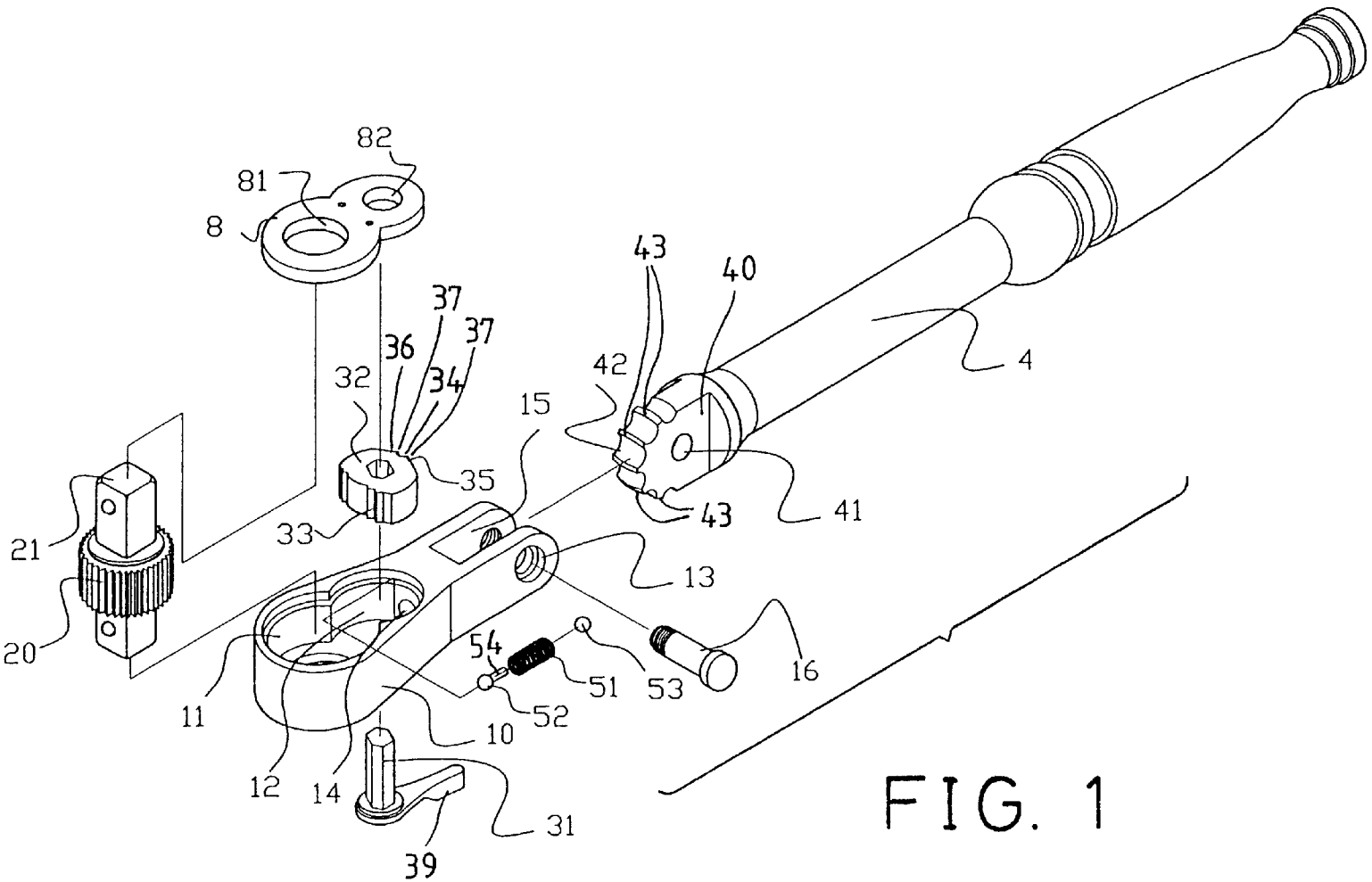
FIG. 1 is an exploded view of a tool in accordance with the present invention.

Referring to the drawings, and initially to FIGS. 1–5, a tool in accordance with the present invention comprises a driving head 10 rotatably secured to a handle 4 with a pivot shaft 16, for allowing the driving head 10 to be rotated relative to the handle 4 at selected angular positions.

The driving head 10 includes two chambers 11, 12, formed therein, such as circular or cylindrical chambers 11, 12 formed in one end thereof and communicating with each other, a channel 15 formed in the other end thereof, and a groove 14 formed in the middle portion thereof and communicating with the chamber 12 and the channel 15 thereof.

The handle 4 includes one end 40 rotatably received in the channel 15 of the driving head 10. The shaft 16 is engaged through two holes 13 of the driving head 10, and an orifice 41 of the handle 4, for rotatably or pivotally securing the driving head 10 to the handle 4, and for allowing the driving head 10 to rotate relative to the handle 4 with the pivot shaft 16.

The end 40 of the handle 4 includes a curved outer peripheral surface facing toward the groove 14 of the driving head 10, and having a number of cavities 42 formed therein and defined by bulges 43 therebetween.

A driving shank 21 includes one or both ends extended out of the driving head 10 for engaging with and for driving fasteners or other tool members, and includes a driving member 20, such as a gear 20 rotatably received in the chamber 11 of the driving head 10. Alternatively, the driving member 20 may includes a non-circular hole formed therein (not shown) for receiving and for driving various fasteners or tool members.

A pawl or an actuator member 32 is rotatably received in the other chamber 12 of the driving head 10 with an activating member 31, and includes two or more teeth 33 provided on one end or one side for selectively engaging with the driving member 20, and for controlling the driving directions of the driving member 20 and/or of the driving shank 21. The teeth 33 of the actuator member 32 may be rotated to selectively engage with the driving member 20 by the activating member 31 to which a hand grip 39 is secured or extended therefrom.

A cover 8 is secured to the driving head 10 with such as fasteners, clamping rings, adhesive materials, or by welding or forging processes, for retaining the driving shank 21 and the actuator member 32 in the driving head 10. The cover 8 includes an aperture 81 formed therein for receiving the driving shank 21, and another aperture 82 formed therein for rotatably receiving one end of the activating member 31.

The actuator member 32 includes an intermediate depression 34 and two side recesses 35, 36 formed in the other end or the other side thereof that faces away from the driving member 20, and that faces toward the handle 4, and includes two cusps 37 formed or provided between the recesses 35, 36 and the depression 34. The intermediate depression 34 of the actuator member 32 is deeper or includes a greater depth than that of the recesses 35, 36 of the actuator member 32, best shown in FIGS. 2 and 4.

Two detent members 52, 53 are received in the groove 14 of the driving head 10, and a spring 51 continuously engaged between the detent members 52, 53 for biasing the detent members 52, 53 to selectively engage with the depression 34 and the recesses 35, 36 of the actuator member 32, and the cavities 42 of the handle 40, and thus to position the driving head 10 to the handle 40 at selected angular positions.

A rod 54 is extended from one or either of the detent members 52, and received between the detent members 52, 53, and received in the spring 51. The rod 54 may be spaced away from the other detent member 53 with a greater distance "D" (FIGS. 2, 3) when the detent member 52 is received in the intermediate deeper depression 34 of the actuator member 32; or with a shorter distance "d" (FIGS. 4, 5) when the detent member 52 is received in either of the side shallower recesses 35, 36 of the actuator member 32.

Figure 2:
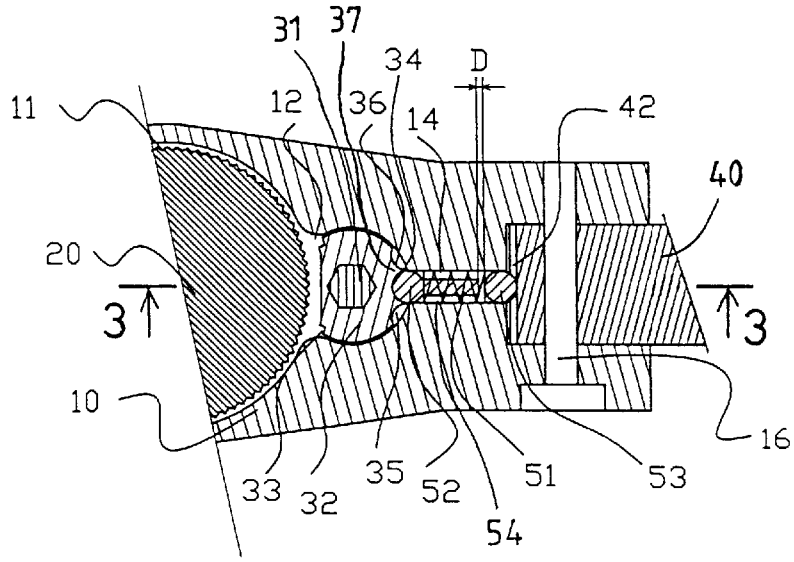
FIG. 2 is a cross sectional view taken along lines 2—2 of FIG. 3.
Figure 3:
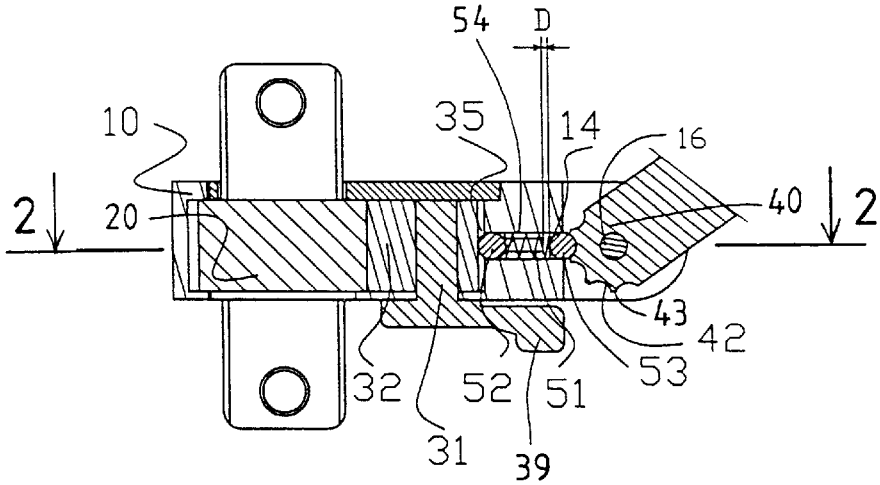
FIG. 3 is a cross sectional view taken along lines 3—3 of FIG. 2.

As shown in FIGS. 2 and 3, when the detent member 52 is received in the intermediate deeper depression 34 of the actuator member 32, the teeth 33 of the actuator member 32 may be disengaged from the driving member 20, such that the driving member 20 may be freely rotated relative to the driving head 10. At this moment, the actuator member 32 is rotated relative to the driving head 10 to a non-working position.

At this moment, the distance "D" between the rod 54 and the detent member 53 is equals to or greater than or no less than the height of the bulges 43 that defined between the cavities 42 of the handle 40, for allowing the handle 40 to be rotated relative to the driving head 10 to any selected angular position.

Figure 4:
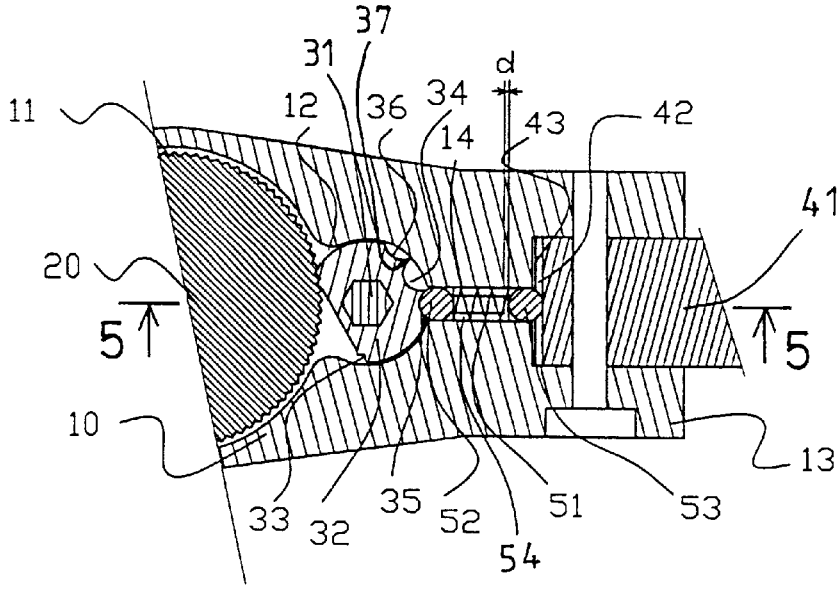
FIG. 4 is a cross sectional view taken along lines 4—4 of FIG. 5.
Figure 5:
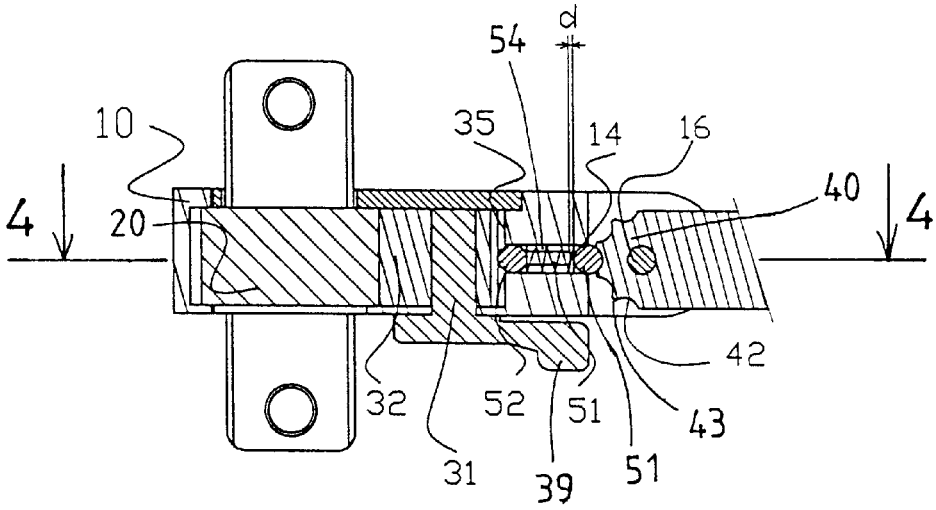
FIG. 5 is a cross sectional view taken along lines 5—5 of FIG. 4.

As shown in FIGS. 4 and 5, when the detent member 52 is received in either of the side shallower recesses 35, 36 of the actuator member 32, either of the teeth 33 of the actuator member 32 may be forced to engage with the driving member 20, in order to control the rotational movement of the driving member 20 relative to the driving head 10. At this moment, the actuator member 32 is rotated relative to the driving head 10 to a working position.

At this moment, the distance "d" between the rod 54 and the detent member 53 is smaller than the height of the bulges 43 that defined between the cavities 42 of the handle 40, such that the handle 40 may not be rotated relative to the driving head 10 at this moment, and such that the handle 40 may be retained to the driving head 10 at the selected angular position or at one of a number of working positions.

The cusps 37 formed or provided or defined between the recesses 35, 36 and the depression 34 include a height arranged for allowing the detent member 52 to be moved between the intermediate deeper depression 34 and the side shallower recesses 35, 36 of the actuator member 32.

In operation, as shown in FIGS. 2 and 3, when the actuator member 32 is rotated relative to the driving head 10 to the non-working position, the teeth 33 of the actuator member 32 are disengaged from the driving member 20, and the driving member 20 may be freely rotated relative to the driving head 10. At this moment, the detent member 52 is received in the intermediate deeper depression 34 of the actuator member 32, such that the handle 40 may be rotated relative to the driving head 10 to any selected angular position, for allowing the detent member 53 to be engaged with either of the cavities 42 of the handle 40.

As shown in FIGS. 4 and 5, when the actuator member 32 is rotated relative to the driving head 10 to the working position, either of the teeth 33 of the actuator member 32 may be engaged with the driving member 20, in order to lock the driving member 20 to the driving head 10. At this moment, the detent member 52 is received in the either of the side shallower recesses 35, 36 of the actuator member 32, such that the handle 40 may not be rotated relative to the driving head 10 and may thus be locked to the driving head 10 at the selected angular position.

At this moment, or when the driving head 10 and/or the driving shank 21 is used to engage with and to drive fasteners or other tool members, the handle 40 may be locked to the driving head 10 and may not be rotated relative to the driving head 10. The handle 40 may be rotated relative to the driving head 10 only when the actuator member 32 is rotated relative to the driving head 10 to the non-working position.

It is to be noted that the spring 51 may be continuously engaged and biased between the detent members 52, 53, for biasing the detent members 52, 53 to engage with either of the depression 34 and the recesses 35, 36 of the actuator member 32, and the cavities 42 of the handle 40, and thus to position the driving head 10 to the handle 40 at selected angular positions. The rod 54 may be used to selectively lock the detent members 52, 53 between the driving head 10 and the handle 40. The rod 54 may alternatively be extended from the other detent member 53 instead of from the detent member 52.

Figure 6:
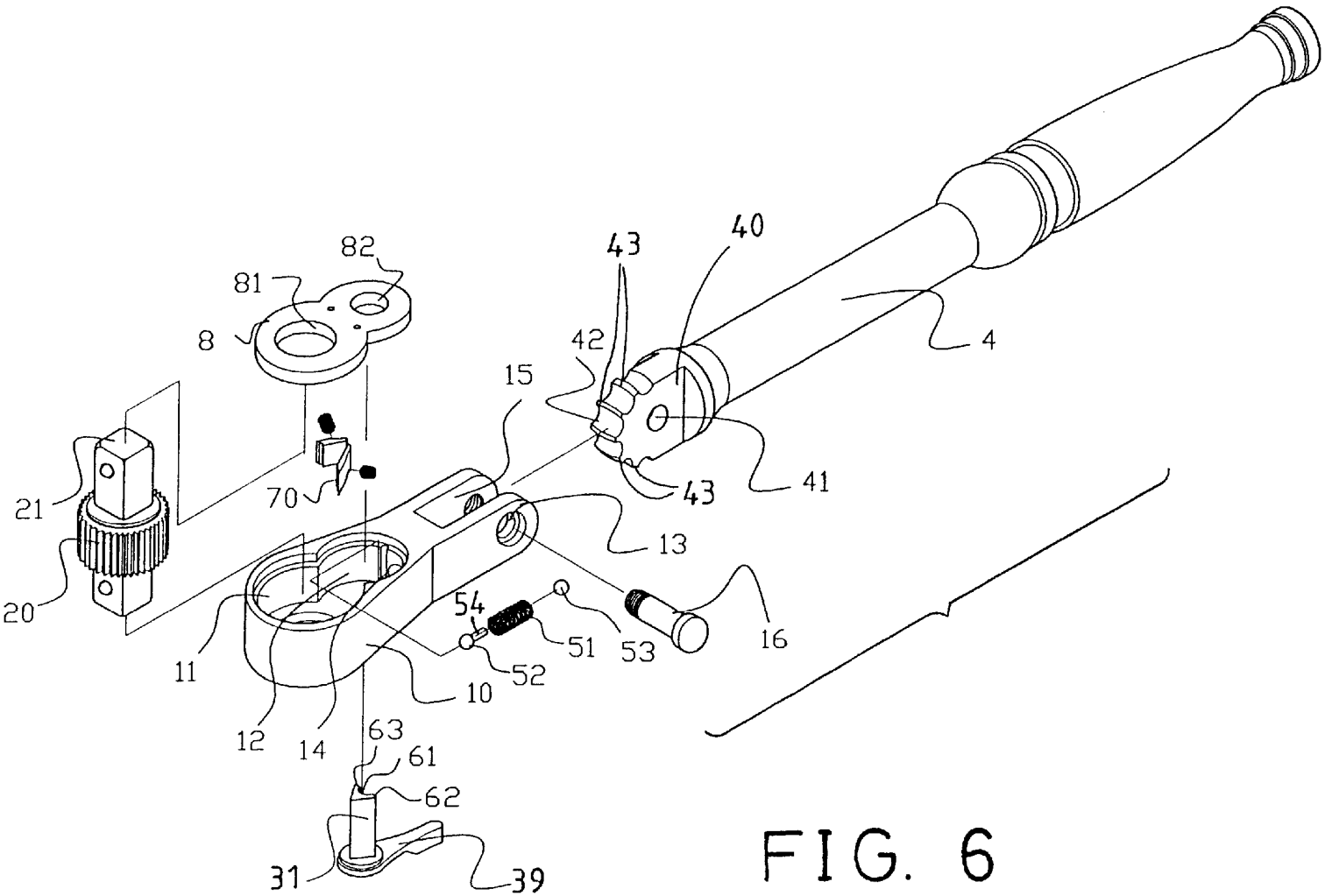
FIG. 6 is an exploded view illustrating another arrangement or embodiment of the tool.
Figure 7:
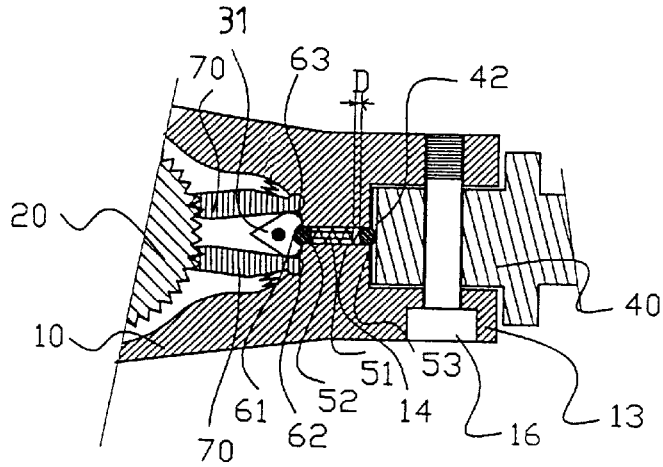
FIG. 7 is a cross sectional view taken along lines 7—7 of FIG. 8.
Figure 8:
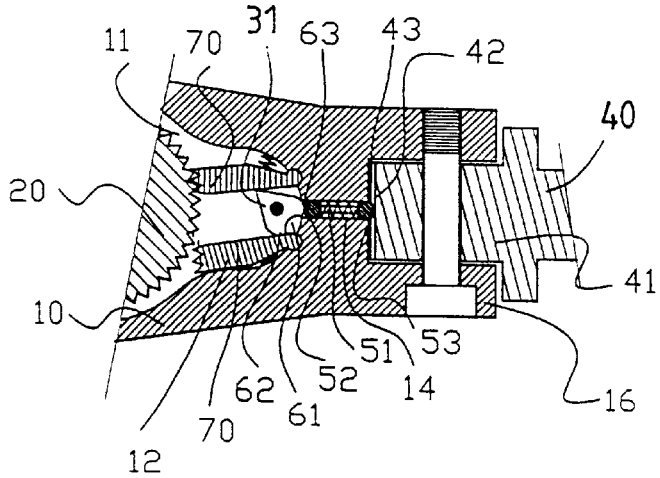
FIG. 8 is a cross sectional view taken along lines 8—8 of FIG. 7.

Referring next to FIGS. 6–8, the activating member 31 may includes an intermediate depression 61 formed between two swellings 62, 63 for receiving the detent member 52. The swellings 62, 63 of the activating member 31 may move the detent member 52 toward the other detent member 53, when the activating member 31 forces either of the detent pawl members 70 to engage with the driving member 20. The spring member 51 may also be continuously engaged and biased between the detent members 52, 53.

Accordingly, the tool in accordance with the present invention includes a spring biasing device or two detent members continuously biased and engaged between the driving head and the handle for preventing the driving head from freely rotating relative to the handle, and for allowing the driving head to be easily rotated relative to the handle without depressing any button.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a first end having a plurality of cavities formed therein and defined between bulges, a driving head including a first end rotatably secured to said first end of said handle, and including a second end, an actuator member rotatably received in said driving head, and rotatable relative to said driving head to a non-working position and at least one working position, and said actuator member including a depression and at least one recess formed therein, a first detent member selectively engageable with said depression and said at least one recess of said actuator member, a second detent member selectively engageable with either of said cavities of said handle, and a spring engaged between said first and said detent members to bias said first and said second detent members to engage with said actuator member and said handle.

2. The tool according to claim 1, wherein said depression of said actuator member includes a depth greater than that of said at least one recess of said actuator member.

3. The tool according to claim 1, wherein said first detent member includes a rod extended therefrom and located between said first and said second detent members.

4. The tool according to claim 3, wherein said bulges of said handle includes a height, a distance between said rod and said second detent member is shorter than said height of said bulges when said actuator member is rotated relative to said driving head at said non-working position, and is greater than said height of said bulges when said actuator member is rotated relative to said driving head at said at least one working position.

5. The tool according to claim 1, wherein said driving head includes a driving member rotatably received in said first end thereof, said actuator member has at least one tooth engaged with said driving member when said actuator member is rotated relative to said driving head at said at least one working position.

6. The tool according to claim 1 further comprising an activating member attached to said actuator member for rotating said actuator member relative to said driving head.

* * * * *